US005816877A

United States Patent [19]

Chuang

[11] Patent Number: 5,816,877

[45] Date of Patent: Oct. 6, 1998

[54] WIRED FLYING MODEL AIRPLANE MANIPULATION

[76] Inventor: Chung-Ming Chuang, No. 38, Jung Hwa San Road, Pei-Tou Chiu, Taipei, Taiwan

[21] Appl. No.: 735,265

[22] Filed: Oct. 22, 1996

[51] Int. Cl.[6] ..... A63H 27/04; A63H 13/20

[52] U.S. Cl. ..... 446/31; 472/8

[58] Field of Search ..... 446/31, 32, 33, 446/34, 454, 456; 432/6, 7, 8, 9, 10

[56] References Cited

U.S. PATENT DOCUMENTS

| | | | |
|---|---|---|---|
| 2,300,649 | 11/1942 | Christiansen | 472/7 |
| 3,696,550 | 10/1972 | Troxell | 446/31 |
| 3,762,702 | 10/1973 | Keele et al. | 472/10 |
| 4,011,684 | 3/1977 | Stanzel | 446/32 |
| 5,030,156 | 7/1991 | Savicky, Sr. | 446/34 X |

FOREIGN PATENT DOCUMENTS

| | | | |
|---|---|---|---|
| 832876 | 10/1938 | France | 472/7 |
| 1287-904 | 2/1987 | U.S.S.R. | 446/31 |

*Primary Examiner*—Robert A. Hafer
*Assistant Examiner*—D. Neal Muir
*Attorney, Agent, or Firm*—Bacon & Thomas

[57] ABSTRACT

A wired flying model airplane manipulation rack for manipulating the flying of a wired model airplane, including a swivel control mechanism having a U-frame turned about a metal axle horizontally through 360° and a swivel member turned within the U-frame vertically over 180°, a traction mechanism adapted to change the direction of the applied force of the operator, for permitting the flying model airplane to be controlled to fly horizontally through 360° and turned in different directions.

5 Claims, 5 Drawing Sheets

WIRED FLYING MODEL AIRPLANE MANIPULATION

BACKGROUND OF THE INVENTION

The present invention relates to wired flying model airplane manipulation devices, and relates more particularly to a wired flying model airplane manipulation rack for manipulating the flying of a wired model airplane, which comprises a swivel control mechanism having a U-frame turned about a metal axle horizontally through 360° and a swivel member turned within the U-frame vertically over 180°, a traction mechanism adapted to change the direction of the applied force of the operator, for permitting the flying model airplane to be controlled to fly horizontally through 360° and turned in different directions.

Regular wired flying model airplanes must be played in an open field, and the operator must stay at the center area of the field so that the flying toy can be operated. However, it is not easy to find a spacious place for playing wired flying model airplanes in cities. Because of this limitation, the game of playing wired flying model airplanes cannot be greatly promoted.

SUMMARY OF THE INVENTION

The present invention has been accomplished under the circumstances in view. It is the main object of the present invention to provide a wired flying model airplane manipulation rack which permits a wired flying model airplane to be controlled to fly horizontally around a rack through 360°, and to turn vertically over 180°. Because the wired flying model airplane is driven to fly around the rack, less operative space is needed, and the operator can operate the flying toy at any area around the operative space.

DETAILED DESCRIPTION OF THE PREFERRED EMBODIMENT

Figure 1:
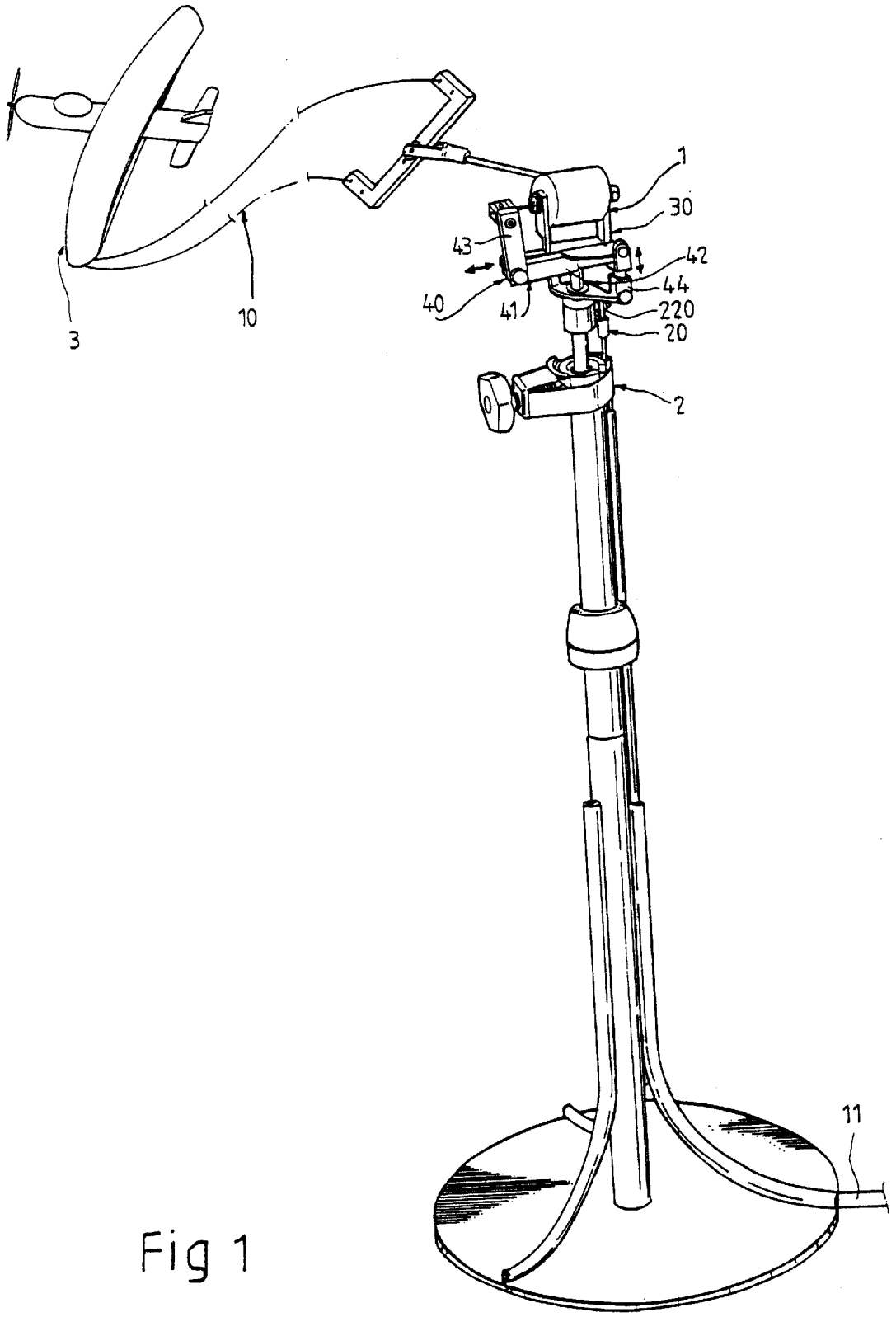
FIG. 1 is an installed view of a wired flying model airplane manipulation rack according to the present invention.
Figure 2:
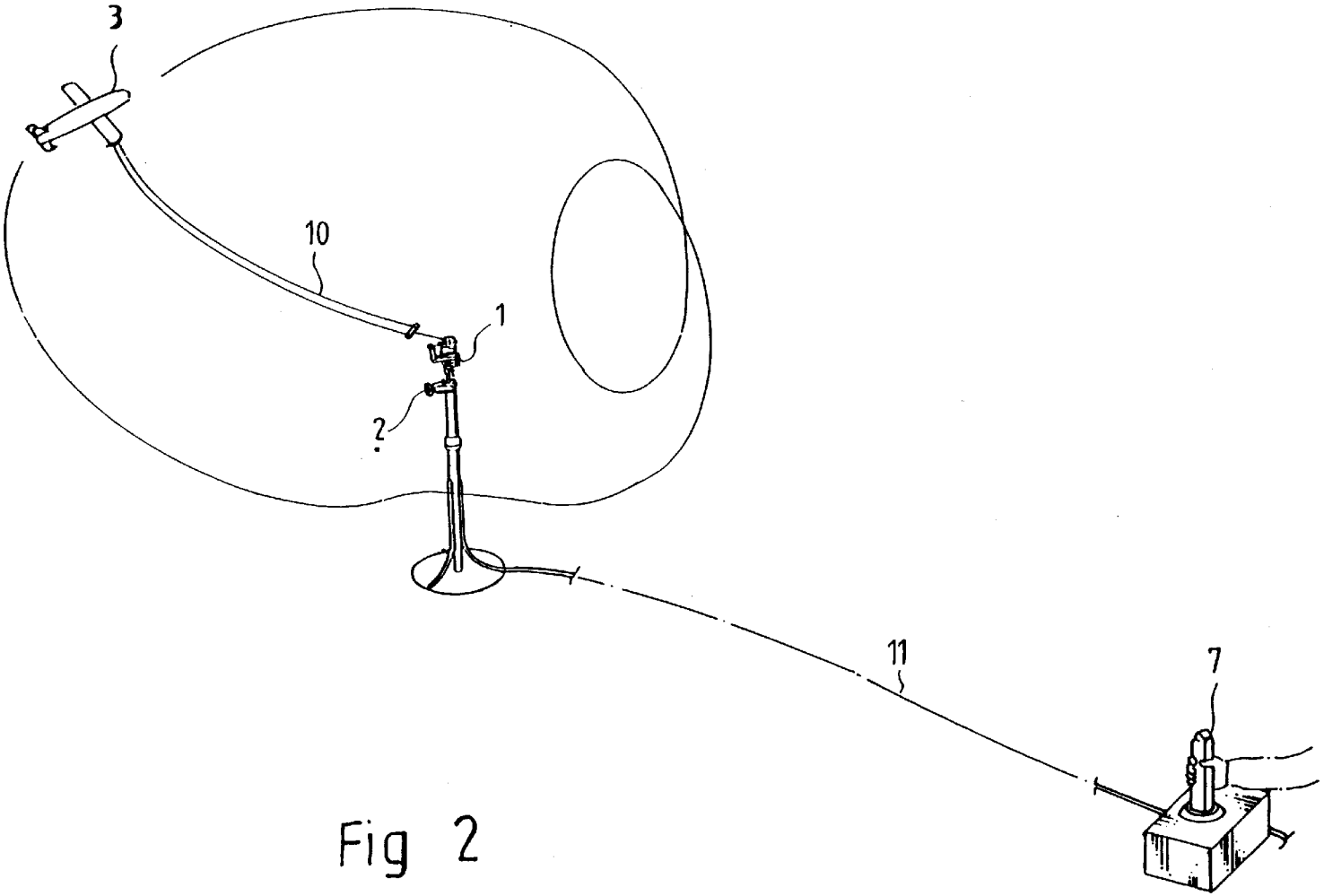
FIG. 2 is an applied view of the present invention, showing the wired flying model airplane manipulation rack operated.

Referring to FIGS. 1 and 2, a wired flying model airplane manipulation rack 1 is mounted on a support 2, and a flying model airplane 3 is connected to the manipulation rack 1 by two conductors 10. The manipulation rack 1 is connected to a manual power control device 7 by a control line 11, which is a cable. By means of the manual power control device 7, the model airplane 3 is manipulated to fly through 360° and to perform any of a variety of fancy flying actions.

Figure 3:
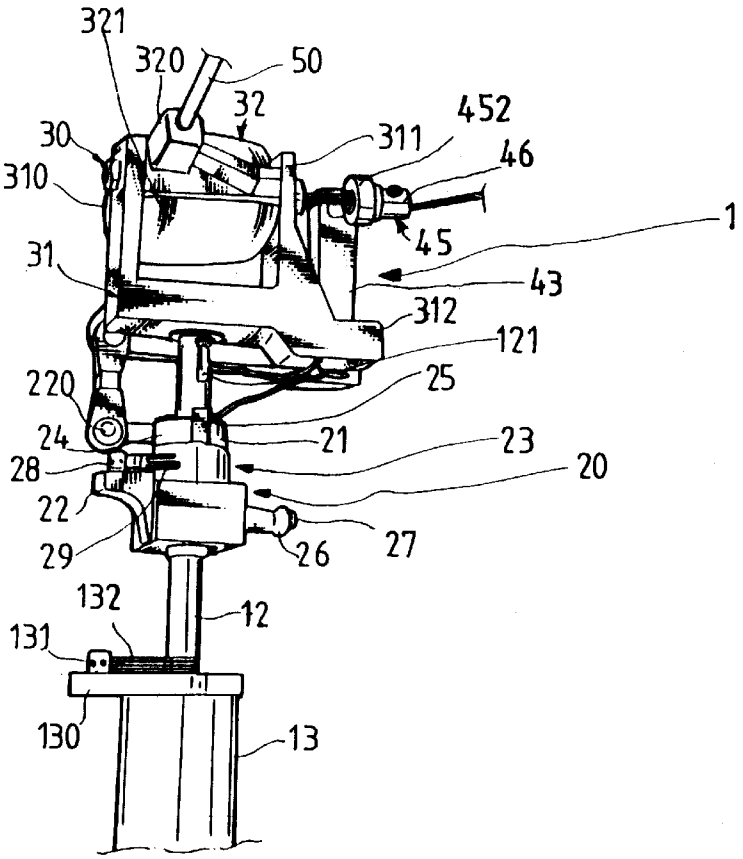
FIG. 3 is an enlarged view of a part of FIG. 1, showing the detailed structure of the wired flying model airplane manipulation rack.

Referring to FIG. 3, the manipulation rack 1 comprises a barrel 13, and a metal axle 12 turned in the barrel 13. The barrel 13 comprises an outward flange 130 raised around the periphery of one end thereof, a seat 131 at the top of the outward flange 130, and a metal contact plate 132 mounted in the seat 131. The metal contact plate 132 of the barrel 13 is disposed so that it is constantly maintained in contact with the metal axle 12. A rotary power transmission mechanism 20 is mounted around the metal axle 12 above the barrel 13. The rotary power transmission mechanism 20 comprises an annular member 21 sleeved onto the metal axle 12 and moved up and down along it, a base frame 22 mounted around the metal axle 12 and disposed at one side of the annular member 21 facing the barrel 13 and turned relative to the annular member 21, and a metal contact element 23 adhered to one side of the annular member 21 and a metal projecting strip 25 raised from the annular body section 24 at one side remote from the metal axle 12. The base frame 22 comprises a locating rod 26 raised from the periphery in a radial direction relative to the metal axle 12, a screw 27 threaded into an axial screw hole (not shown) in the locating rod 26, a seat 28 at the top, and a metal contact plate 29 mounted in the seat 28. The metal contact plate 29 of the base frame 22 is disposed so that it is constantly maintained in contact with the metal contact element 23. The annular member 21 comprises a radial lug 220 raised from the periphery. A swivel control mechanism 30 is mounted on the metal axle 12 at the top above the rotary power transmission mechanism 20. The swivel control mechanism 30 comprises a U-frame 31 turned about the metal axle 12, and a swivel member 32. The U-frame 31 comprises two parallel side walls 310, 311 having a respective mounting hole 3100, 3110 aligned with each other, a locating block 312 raised from one side at the bottom, and a metal projecting strip 121 raised from the bottom. The swivel member 32 is comprised of a solid block 320, and a counterweight 321. The solid block 320 has for example a trapezoidal shape. The counterweight 321 is shaped like an oval drum, and fastened to one side of the solid block 320. The counterweight 321 is preferably made having a longitudinal coupling groove into which one side of the counterweight 321 fits. The counterweight 321 is much heavier than the solid block 320. The solid block 320 has a pivot hole (not shown), and angled 90° through hole (not shown).

Figure 4:
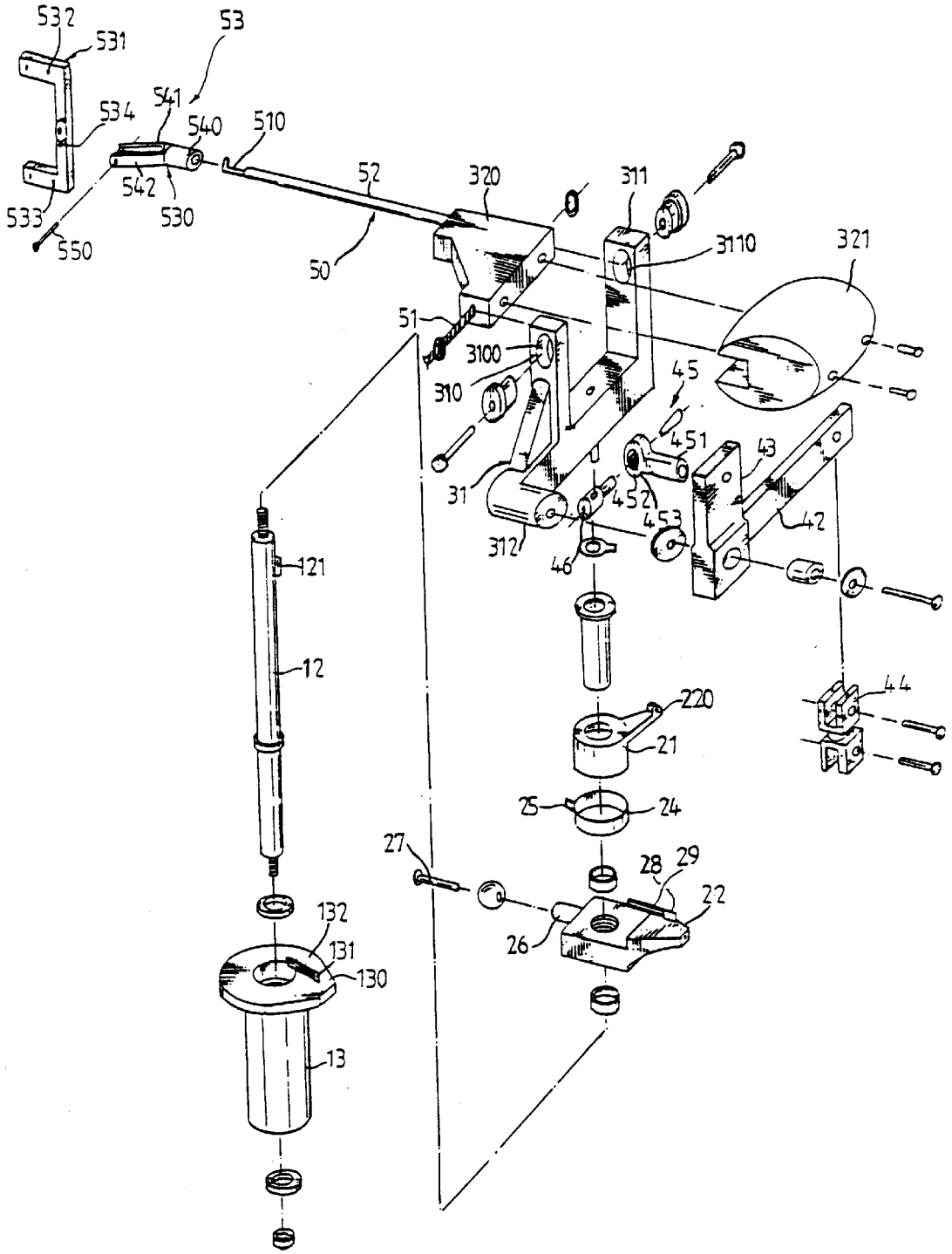
FIG. 4 is an exploded view of FIG. 3.

Referring to FIG. 4, and FIG. 1 again, a steering control mechanism 40 is provided comprised of a linkage 41. The linkage 41 comprises a first rod 42, a second rod 43 connected to one end of the first rod 42 at right angles, a third rod 44 connected to an opposite end of the first rod 42, a steering member 45 connected to one end of the second rod 43 remote from the first rod 42. The steering member 45 is comprised of a ball socket 452, a ball 453 turned within the ball socket 452 and having a through hole (not shown), and a rod 451 having one end perpendicularly raised from the periphery of the ball socket 452 and an opposite end connected to the second rod 43.

A traction mechanism 50 is provided having a control line 51. The control line 51 is inserted through the through hole of the solid block 320 of the swivel control mechanism 30 and the through hole of the ball 453 of the steering member 45 of the steering control mechanism 40 and connected to a rod 510. A protective tube 52 is sleeved onto the control line 51 and spaced between the rod 510 and the solid block 320. A control element 53 is connected to one end of the protective tube 52. The control element 53 comprises a mounting frame 530 and a U-plate 531 fastened to the mounting frame 530 by a fastening element 550. The mounting frame 530 comprises a tubular base 540 connected to the protective tube 52 and having two projecting trips 541, 542 bilaterally disposed at one end. The U-plate 531 has two locating holes 532 and 533 respectively disposed at two opposite sides, and a through hole 534 in the middle. The assembly process of the traction mechanism 50 is outlined hereinafter. When the tubular base 540 of the mounting frame 530 is sleeved the protective tube 52 at one end, the rod 510 is bent through a certain angle and then coupled to the through hole 534 of the U-plate 531.

The relationship between the steering control mechanism 40, the rotary power transmission mechanism 20, the rotary control mechanism 30, and the traction mechanism 50 is outlined hereinafter. The control line 51 of the traction mechanism 50 has one end connected to the rod 510, and an opposite end inserted through the protective tube 52 and the solid block 320 and the ball 453 and then secured outside the ball socket 452 by an end member 46 (the control line 51 can be a twisted wire, or any suitable material). The connecting area between the first rod 42 and second rod 43 of the linkage 41 of the steering control mechanism 40 is pivoted to the locating block 312 of the U-frame 31. The third rod 44 of the linkage 41 of the steering mechanism 40 is connected to the radial lug 220 of the rotary power transmission mechanism 20.

Referring to FIGS. 1 and 3 again, the cable 11 is connected to power supply. The grounding terminal of the cable 11 is connected to the metal contact plate 132 of the seat 131 of the barrel 13, the positive terminal thereof is connected to the screw 27 of the locating rod 26 of the rotary power transmission mechanism 20 and metal contact plate 29 of the seat 28 of the base frame 22. Further, the conductors 10 are respectively connected to the metal projecting strip 121 of the U-frame 31 and the metal projecting strip 25 of the metal contact element 23 of the rotary power transmission mechanism 20. Therefore, the conductors 10 are connected to power supply. Further, the conductors 10 are respectively inserted through the locating holes 532, 533 of the U-plate 531 of the traction mechanism 50.

Referring to FIG. 1 again, the rotary power transmission mechanism 20, the swivel control mechanism 30, the steering control mechanism 40, the traction mechanism 50, and the conductors 10 are moved relative to one another in a manner as outlined hereinafter. When the operator operates the power control device, driving power is transmitted through the control line 11 to the radial lug 220 of the rotary power transmission mechanism 20, causing the rotary power transmission mechanism 20 to be moved up and down along the metal axle 12. At the same time, the steering control mechanism 40 is moved by the rotary power transmission mechanism 20, causing the third rod 44 of the steering control mechanism 40 to be moved up and down. When the third rod 44 of the steering control mechanism 40 is moved up and down, the steering member 45 is oscillated with the second rod 43 leftwards and rightwards (because the connecting area between the second rod 43 and the first rod 42 is pivoted to the locating block 312 of the U-frame 31), and at the same time the control line 51 of the traction mechanism 50 is pulled and released (reciprocated relative to the U-frame 31). When the control line 51 is reciprocated, the rod 510 is driven to turn the U-plate 531 up and down, thereby causing the conductors 10 to be alternatively pulled in the locating holes 532, 533 of the U-plate 531.

Figure 5:
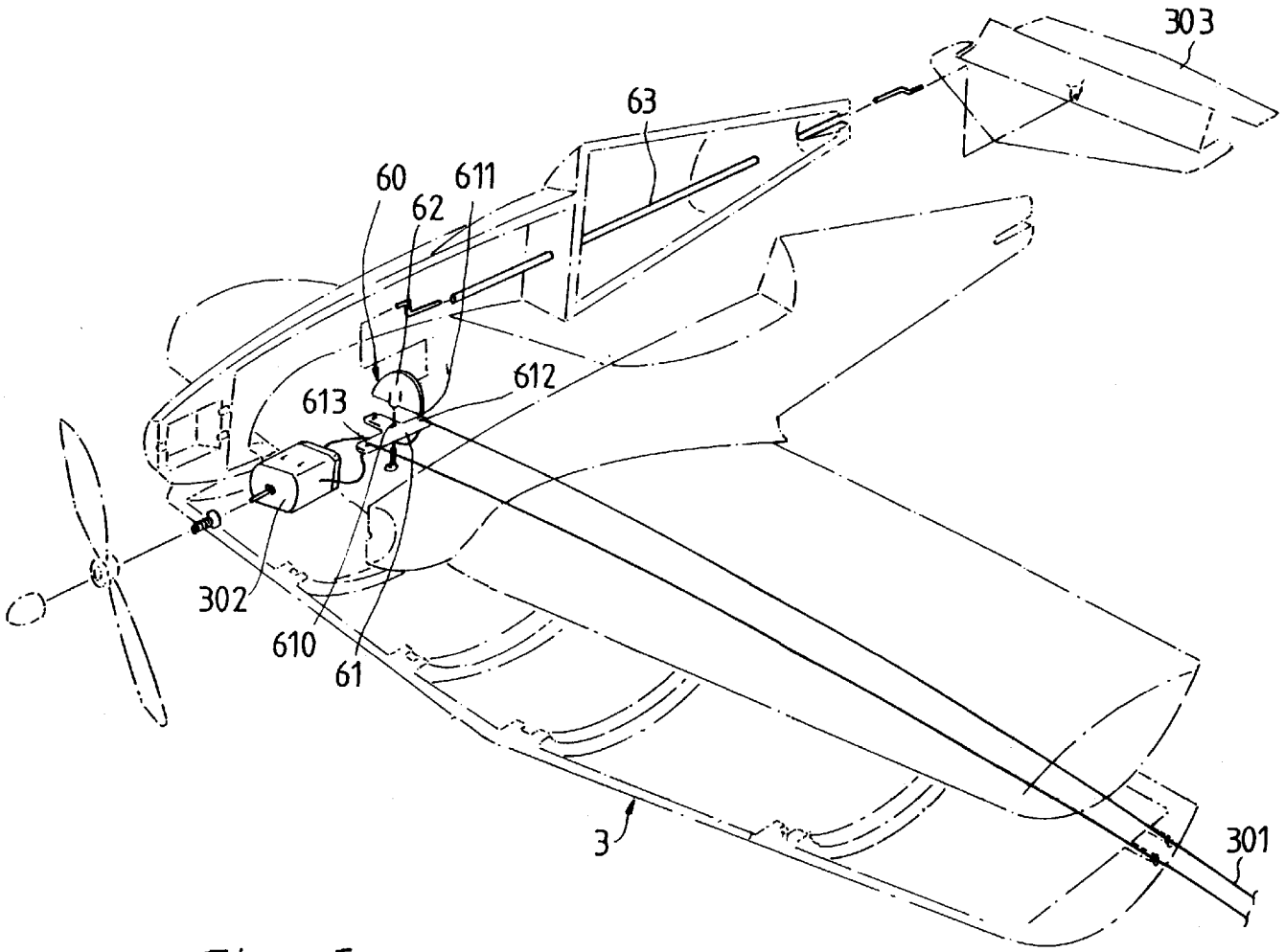
FIG. 5 is a perspective exploded view of the flying model airplane shown in FIG. 1.

Referring to FIG. 5, the conductors 10 are respectively connected to the two conductors 301 at the power input end of the model airplane 3. The model airplane 3 comprises a motor 302 of which the necessary working power supply is provided from the conductors 301. By means of the conductors 301, the tail unit 303 of the model airplane 3 is controlled to oscillate up and down, and therefore the flying of the model airplane 3 is manipulated. Because the swivel control mechanism 30 is mounted with a counterweight 321, the U-frame 31 is maintained balanced when the model air plane 3 flies horizontally. Further, because the U-frame 31 is pivoted to the swivel member 32 and turned about the metal axle 12, the model airplane 3 can be manipulated to fly through 360° around the manipulation rack 1 and to perform any of a variety of fancy flying action.

The model airplane 3 comprises a steering mechanism 60 behind the motor 302. The steering mechanism 60 comprises a T-plate 61 and a transmission rod 63. The T-plate 61 has a mounting hole 610 at the center. The transverse section 611 of the T-plate 61 has two mounting holes 612, 613 near two opposite ends. The transmission rod 63 is connected to the tail unit 303. When the conductors 10 are alternatively pulled and released, the conductors 301 are relatively moved, thereby causing the steering mechanism 60 to turn tail unit 303 up and down.

While only one embodiment of the present invention has been shown and described, it will be understood that various modifications and changes could be made thereunto without departing from the spirit and scope of the invention disclosed.

What the invention claimed is:

1. A wired flying model airplane manipulation rack mounted on a support and controlled to control the flying of a wired flying model airplane connected thereto, comprising:

a swivel control mechanism mounted on a metal axle, which is turned in a barrel, said swivel control mechanism comprising a U-frame pivoted to said metal axle, and a swivel member pivoted to said U-frame and turned to control the oscillation of the wired flying model airplane, the weight of said swivel member matching that of the flying model airplane; and a traction mechanism comprising at least one control line having one end connected to the swivel member of said swivel control mechanism and an opposite end connected to at least one control element connected to the flying model airplane by wires, wherein said at least one control line is inserted through a hole in said swivel member and a hole in said U-frame and connected to a steering control mechanism, said steering control mechanism connected to a rotary power transmission, which is moved vertically long said metal axle, said steering control mechanism comprising a linkage having a plurality of rods and connected to said at least one control line, and a steering member connected to said linkage, said linkage converting a vertically applied force into a horizontal force so that said at least one control element is moved when said at least one control line is moved horizontally;

wherein said swivel member can be pivoted 180° relative to said U-frame and said control element is pulled by said at least one control line to move said at least one control line to control the flying model airplane.

2. The wired flying model airplane manipulation rack of claim 1 wherein the flying model airplane is connected to a power supply through an external electric cable, the electric cable serving as a connecting wire connected between the manipulation rack and the flying model airplane.

3. The wired flying model airplane manipulation rack of claim 1 wherein each of said at least one control line is comprised of a wire and a rod connected to one end of the wire.

4. The wired flying model airplane manipulation rack of claim 1 further comprising a protective tube enclosing at least a portion of said at least one control line.

5. The wired flying model airplane manipulation rack of claim 1 wherein each of said at least one control line comprises a twisted wire.

* * * * *